US006467576B2

(12) United States Patent
Figura et al.

(10) Patent No.: US 6,467,576 B2
(45) **Date of Patent: *Oct. 22, 2002**

(54) AERIAL LIFE SAVER COMBINE

(75) Inventors: Gyorgy I. Figura; Ivan K. Fugura, both of Fullerton, CA (US)

(73) Assignee: Combustion Associates, Inc., Corona, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/746,925

(22) Filed: Dec. 21, 2000

(65) Prior Publication Data

US 2002/0079163 A1 Jun. 27, 2002

(51) Int. Cl.[7] ..... E04C 1/00; E04G 1/00
(52) U.S. Cl. ..... 182/63.1; 182/3; 182/2.5
(58) Field of Search ..... 182/63.1, 69.4, 182/69.6, 2.5, 141, 3

(56) References Cited

U.S. PATENT DOCUMENTS 2,565,777 A * 8/1951 Moon ..... 182/63.1 X
3,451,504 A * 6/1969 Logan ..... 182/2.5 X
3,625,306 A * 12/1971 Sauer ..... 182/69.4
3,664,458 A * 5/1972 Sterns et al. ..... 182/141 X
3,882,964 A * 5/1975 Schellenberg ..... 182/141 X
3,910,264 A * 10/1975 Mahieu ..... 182/141 X
4,427,093 A * 1/1984 Wehmeyer et al. ..... 182/141
5,295,555 A * 3/1994 Strange ..... 182/2.5
5,555,953 A * 9/1996 Henderson ..... 182/141
6,092,623 A * 7/2000 Collavino ..... 182/3

* cited by examiner

*Primary Examiner*—Daniel P. Stodola
*Assistant Examiner*—Hugh B. Thompson
(74) *Attorney, Agent, or Firm*—Drummond & Duckworth

(57) ABSTRACT

The "Aerial Life Saver Combine" is a multipurpose mobile safety system that is used in relation to work performed on top of any kind of vehicle or on stationary structures where fall safety protection for workers in service, maintenance and construction is required. The uniqueness of this product is that one vehicle can do the job of two or more equipment to protect workers from a fall throughout their entire activity. Several accidents can be avoided by eliminating passages from equipment to equipment securing in such a way adequate anchorage for all time spent above ground. Wearing the proper harness, the user of the vehicle is protected by rails climbing the stairway and walking upon the platform. A gate secures the front of the platform. Thereafter, the worker attaches his harness —located at his back —to one of the life-lines previously installed between the anchor points and platform rail hooks. He then opens the front gate and walks onto the working area safely. In this way, a fall is avoided or limited to the maximum fall distance specified by existing standards.

4 Claims, 8 Drawing Sheets

AERIAL LIFE SAVER COMBINE

BACKGROUND OF THE INVENTION

The present invention relates to mobile staging and scaffolding for working in high places. More particularly, the invention relates to mobile scaffolds intended for use in environments requiring that the user depart from the scaffold structure to work in the surrounding vicinity of the scaffold.

Various mobile scaffold constructions have been devised for working in high places. These devices typically include a frame and a plurality of wheels for enabling the structure to be propelled over distances. Attached to the frame are typically stairs or ladder rungs enabling a user to climb the structure. Typically, on each side of the stairs or ladder rungs are handrails for safety purposes.

The mobile scaffolding often includes a platform at the top of the stairway enabling a user additional area to operate. For example, U.S. Pat. No. 2,362,170 and U.S. Pat. No. DES.411,019 describe mobile scaffold structures including a plurality of stairs which are framed on each side with handrails. At the top of the stairway, a platform is provided which also includes railing on both the left and the right side of the platform. However, some mobile scaffolding, such as described in U.S. Pat. No. 2,363,170, include a platform which is open-ended so that after climbing the scaffold stairway and reaching the platform, one can extend from or walk off the platform's end. The open-ended platform provides the user with freedom to operate beyond the constrains of the platforms itself and a departure point enabling the user to depart from the scaffolding to work in other areas, such as upon the wings or fuselage of an airplane. Unfortunately, users of scaffolding including open-ended platforms are susceptible to falls making such scaffold unacceptably dangerous. In fact, such scaffolding has been prohibited throughout much of the United States pursuant to municipal, state and Federal safety codes.

Alternative, mobile scaffolds typically include a platform at the top of the stairway which is surrounded on three sides by safety railing. Although this construction is significantly safer than mobile scaffolds having a platform with railing on only two sides, the construction hinders a user's ability to operate or manipulate tools beyond the physical constrains of the railing itself.

Thus, there is a significant need for a mobile scaffold which enables users to safely work in high places outside of the dimensions of the scaffold itself. Even more particularly, there is a need for a mobile scaffold which enables users to operate safely on the exterior of airplanes, such as on the wings and fuselage, while being protected against falls.

Further, it would be advantageous to provide a mobile scaffolding which enables users to safely work outside of the physical constrains of the scaffolding which is adjustable in height.

SUMMARY OF THE INVENTION

The present "Aerial Life Saver" invention addresses the aforementioned disadvantages by providing a new solution for a safe working environment. Applications for the aerial lifesaver of the present invention are unlimited, extending to any work place environment where human lives should be protected against falls. The aerial lifesaver may be used in connection with any tasks which are required to be conducted on top of any vehicle, such as upon airplanes, trains, trucks, automobiles, etc. In addition, the aerial lifesaver may be used in connection with work on stationary structures, such as buildings, water tanks, bridges, or wherever people are susceptible to the danger of falls, including workers engaged in tasks involving service, maintenance and construction.

For manufacturing simplicity, it is preferred that the aerial lifesaver's base section is rectangular including a pair of longitudinal beams and a pair of transverse beams which are joined at their ends to form a frame. Attached to each corner of the frame are wheels enabling the base section to be easily moved. The base section also includes a turret assembly for pivotally-mounting the step assembly so that the step assembly can be lowered or raised according to the needs of the user. The step assembly further includes a plurality of stairs or ladder rungs enabling the step assembly to be climbed. In order to raise and lower the step assembly, any suitable means may be utilized. Preferably, the step assembly is raised or lowered with a hydraulic or pneumatic system. The step assembly preferably also includes handrails on each side extending along its length for protecting the user.

The aerial lifesaver also includes a platform at the top of the step assembly. The platform may be of any size or configuration, depending on the tasks needing to be completed. Preferably, the platform includes side handrails on each side and an operable front gate. Opening of the front gate provides for an open ended construction enabling a user to climb the stairway, cross the platform, and walk off its end.

Protecting the user from falling is a safety assembly including a safety rail which projects horizontally overhead of the platform. The safety rail is maintained in place by a safety rail support arm, which in a preferred embodiment extends from the uppermost extremity of the step assembly. The safety rail may take any number of constructions as can be determined by those skilled in the art. For example, the safety rail may be constructed of a simple I-beam. Preferably, the safety rail also includes one or more anchor points for attaching a lifeline.

The aerial lifesaver of the invention is intended for use in cooperation with persons wearing a harness attached to a lifeline. Preferably, the safety lifeline is extendible and self-retracting including an inertial lock similar to those found in conventional automobile seat belt assemblies so that if one using the aerial lifesaver falls from the platform, the inertial lock will prevent further extension of the lifeline and further falling of the user.

In operation, before the aerial lifesaver is moved to a desired work location, a required number of lifelines of required lengths are attached to the platform siderails and anchor points. After the step assembly is lifted to a desired height, the user wearing the proper harness climbs the stairway protected by the stairway siderails. Thereafter, he walks upon the platform protected on three sides by the side rails and closed gate. Before opening the gate, the user attaches the free end of his harness to the platform end of the lifeline extending from an anchor point. Upon opening the gate, the platform becomes open-ended and the user is free to leave the platform and walk safely to a working position. The user is protected from falls, and particularly protected against falling off the platform's open end, as the lifeline connected to the user's harness prevents the user from striking the ground.

Thus, an object of the present invention is to provide an aerial lifesaver which enables users to work in high places, such as on the fuselage or wing of an airplane.

It is another object of the present invention to provide an aerial lifesaver which enables one to exit the structure but still be protected against inadvertent falls.

Other features and advantages of the present invention will be appreciated by those skilled in the art upon reading the detailed description which follows with reference to the attached drawings.

DETAILED DESCRIPTION OF THE INVENTION

Figure 1:
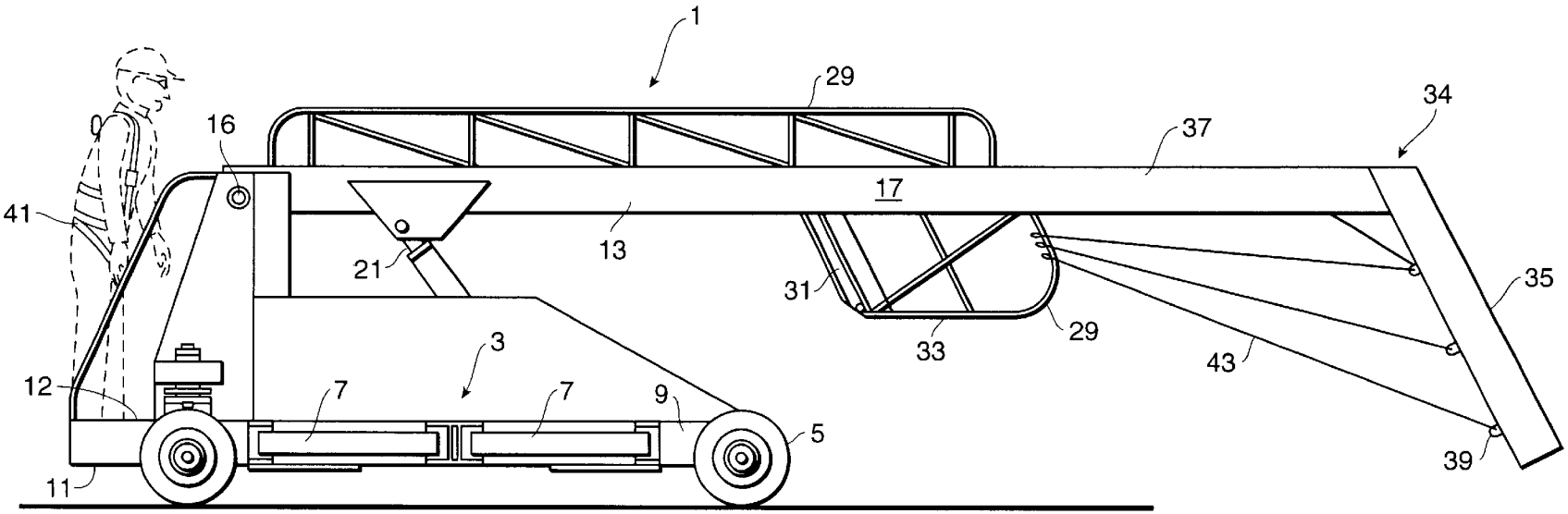
FIG. 1 is a side view of the aerial lifesaver of the present invention.

While the present invention is susceptible of embodiment in various forms, there is shown in the drawings and will hereinafter be described the presently preferred embodiments of the invention, with the understanding that the present disclosure is to be considered as an exemplification of the invention and is not intended to limit the invention to the specific embodiments illustrated.

Figure 2:
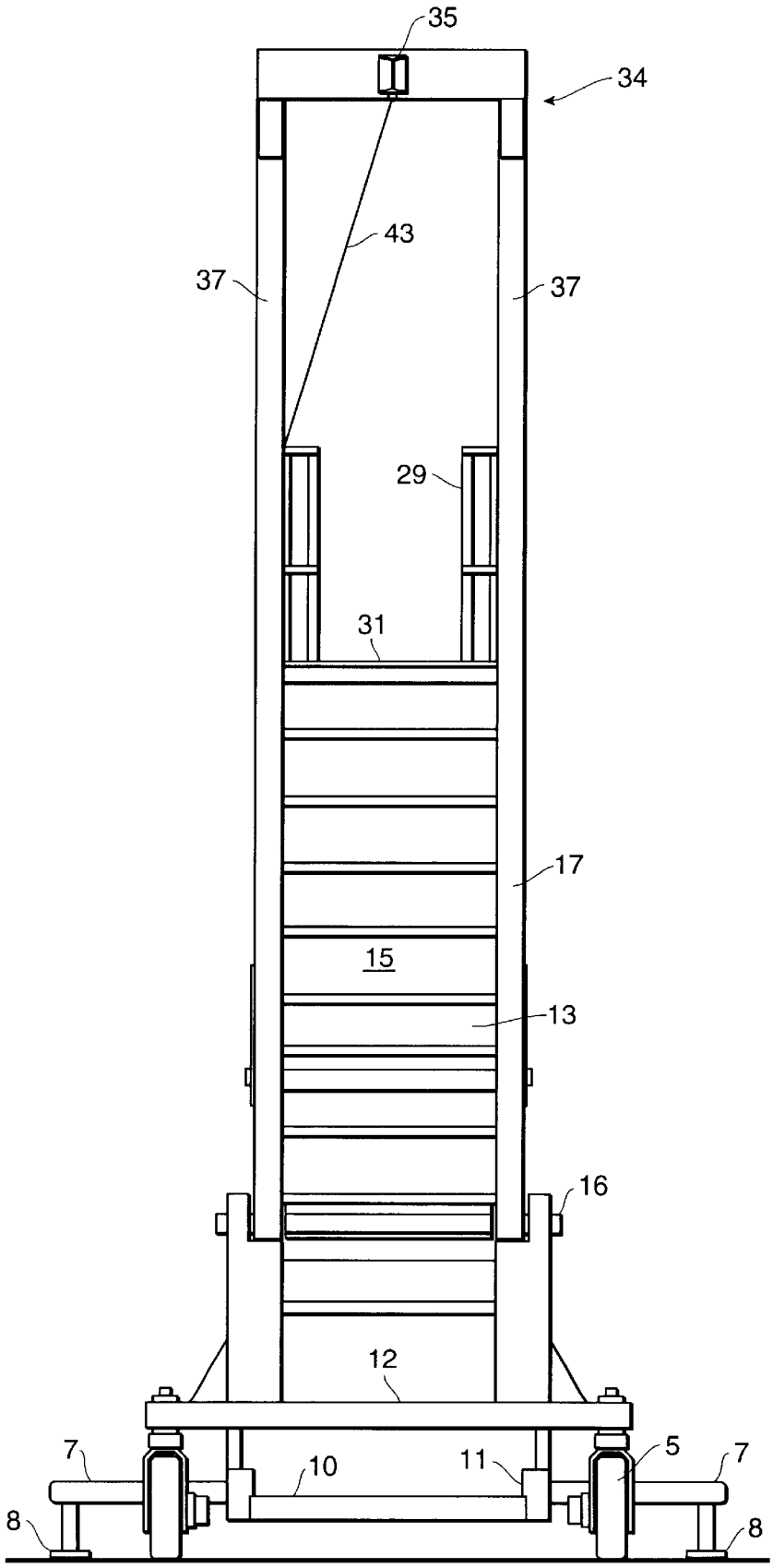
FIG. 2 is a rear view of the aerial lifesaver of the present invention.
Figure 3:
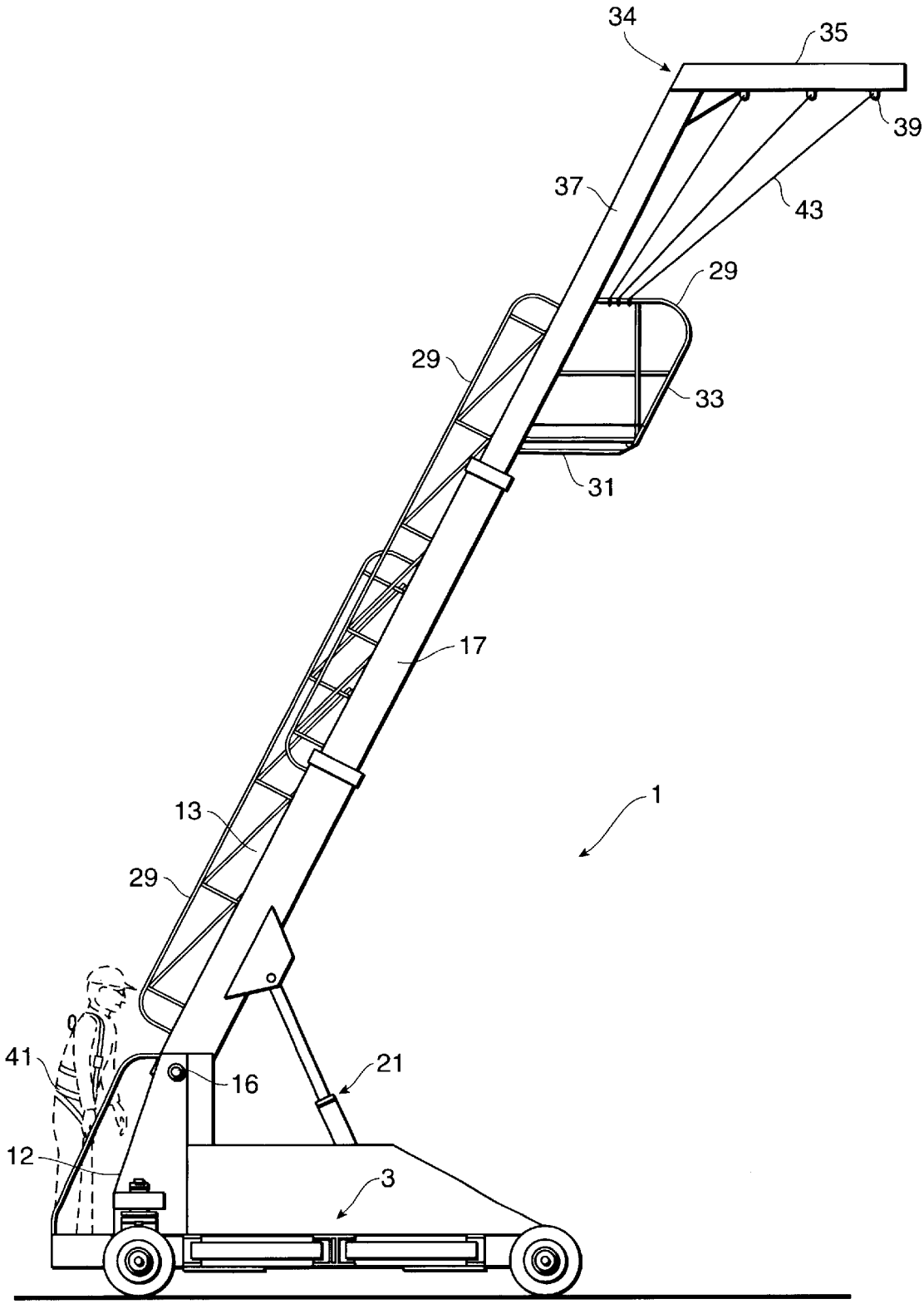
FIG. 3 is a side view of the aerial lifesaver of the present invention illustrating an extendible and retractable step assembly.
Figure 4:
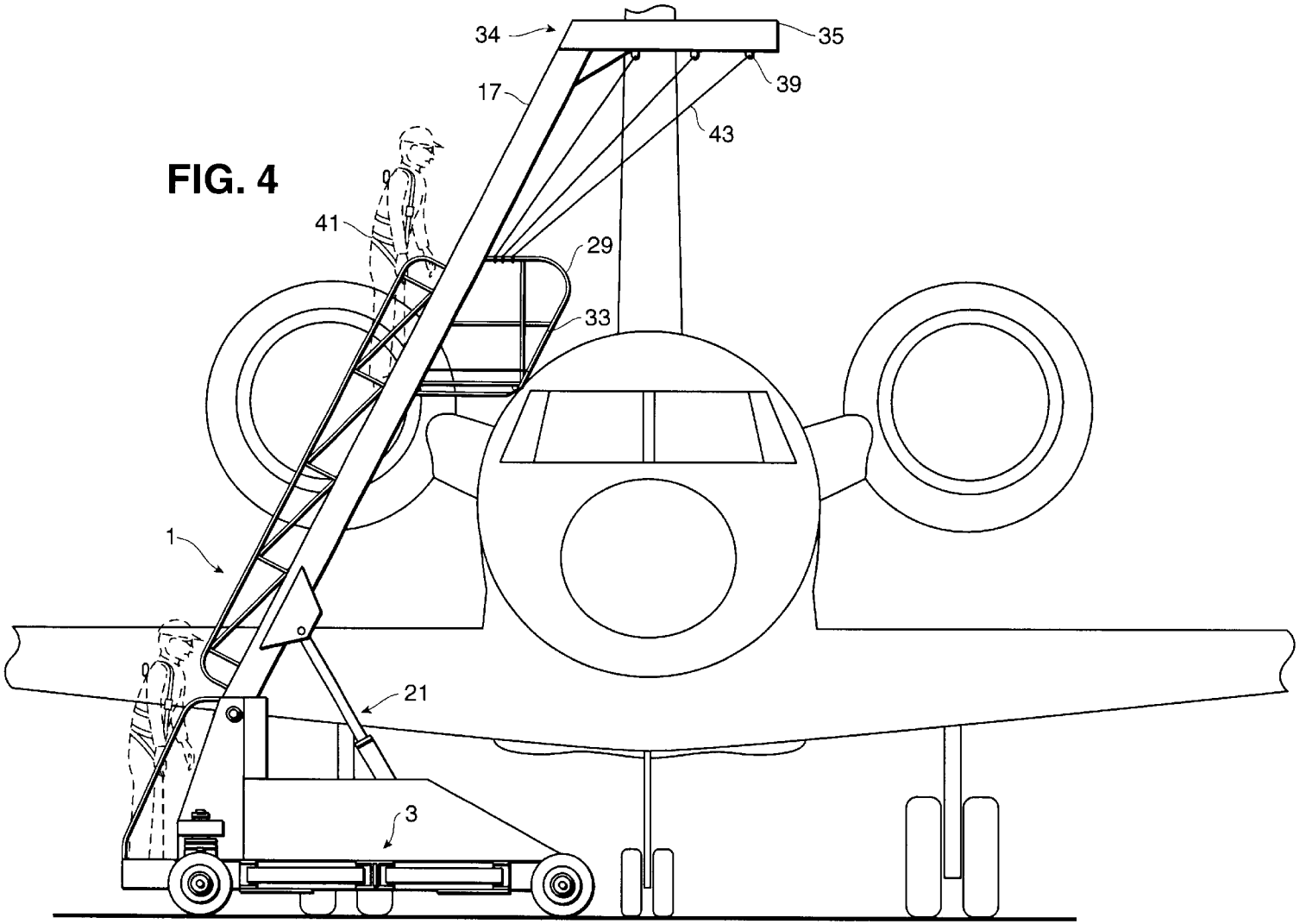
FIG. 4 is a side view of the aerial lifesaver, of the present invention illustrating its use for assisting a person working on the fuselage of an airplane.
Figure 5:
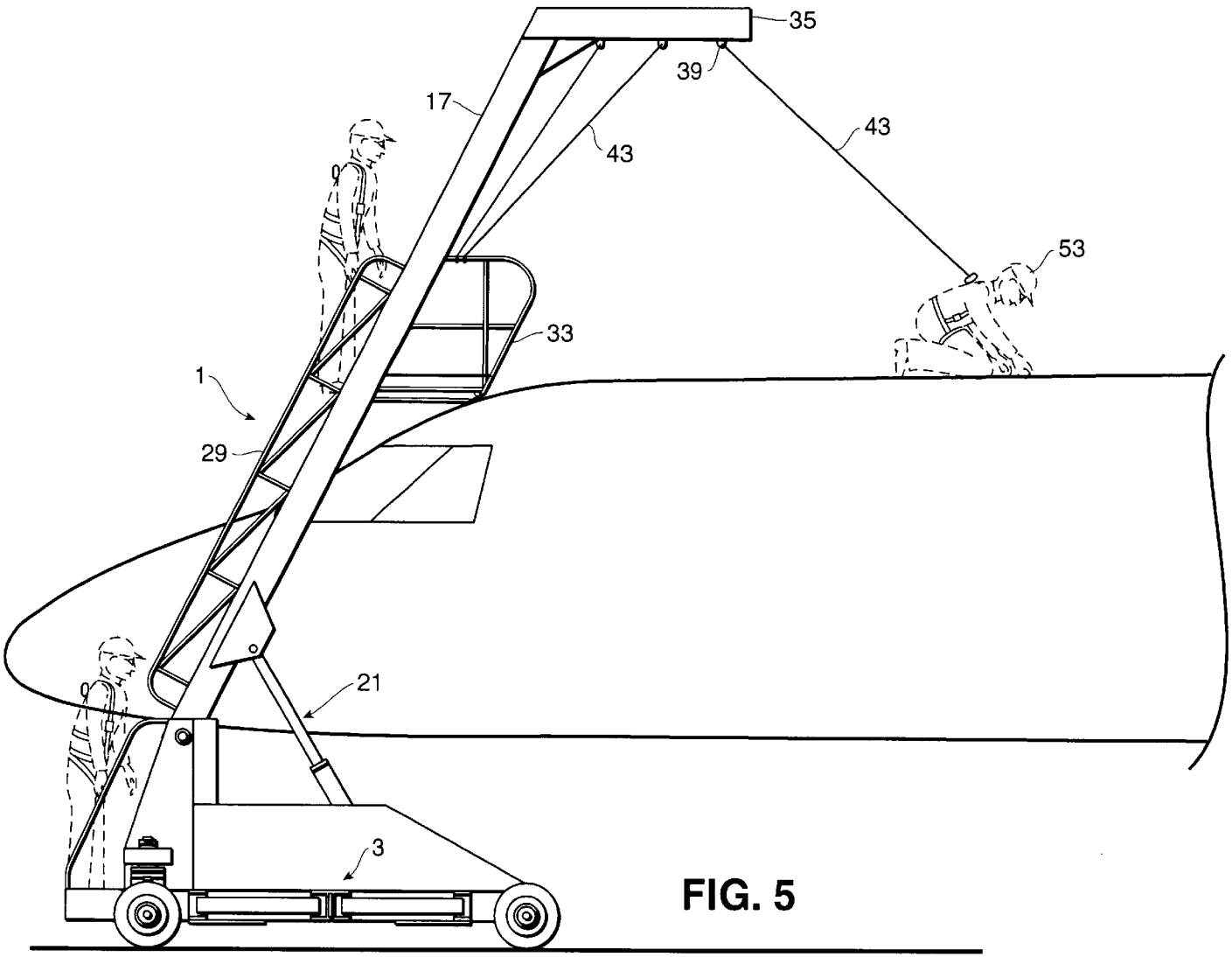
FIG. 5 is an additional side view of the aerial lifesaver of the present invention illustrating its use for assisting a person working on the fuselage of an airplane.

With reference to the figures, and particularly FIGS. 1–3, the invention is directed to an aerial lifesaver 1 including a wheeled base section 3 for supporting a step assembly 13. The base section 3 may be constructed in various configurations, as would be understood to those skilled in the art. However, in a preferred embodiment, the base section 3 is substantially rectangular including a pair of longitudinal support members 9 and a pair of transverse support members 10 which are joined at their extremities to form a rectangular frame 11. The aerial lifesaver 1 includes a plurality of wheels 5 for making it mobile. As shown in the figures, in a preferred embodiment, the aerial lifesaver 1 includes four wheels 5 with a single wheel located at each corner of the frame 11. The base section 3 may be propelled manually by manually pushing on the aerial lifesaver to force it to desired locations. In the alternative, the aerial lifesaver 1 of the invention may include a electro-hydraulic drive or combustionengine for driving the wheels. Controls (not shown) for operating the motor or engine and for steering the wheels 5 are preferably located at a control deck 12 which is located at one extremity of the base section 3.

Preferably, extending from each side of the base section 3 are outrigger arms 7. The outrigger arms 7 are provided with pivoting cylinder support bases 8 for engaging the ground. The vertical position of the support bases 8 is adjustable so that they may be raised to disengage the ground when the aerial lifesaver is moved, but lowered to engage the ground and locked in place to stabilize the aerial lifesaver when the combine is stationary.

The step assembly 13 is pivotally mounted to the base section 3 by a turret assembly 14 which projects upwardly from the base section 3, preferably adjacent to the control deck 12. The step assembly 13 includes a pair of spaced-apart parallel stairway support members 17 which are connected by steps 15. The steps may be constructed as stairs or ladder rungs. Moreover, the stairway support members 17 may be constructed of individual telescoping elements to provide an extendible and retractable stairway as shown in FIG. 3.

In addition to the stairway support members 17 being extendible and retractable, the step assembly 13 can be raised or lowered about turret assembly 14. Any suitable means for forcing the step assembly upward or downward may be utilized. In preferred embodiments, hydraulic or pneumatic cylinders 21 are provided for controlling the angle of the step assembly. Additional means for[ c]ontrolling the angle of the step assembly include threaded jack constructions now shown in the figures. Controls for operating the different means for raising or lowering the step assembly are preferably also located on the control deck 12 adjacent to any controls for motorized moving of the aerial lifesaver.

In order to safeguard those persons climbing the step assembly 13, side handrails 29 are provided which extend upwardly on each side of the stairs from the stairway support members 17. With reference to FIG. 3, where the step assembly is telescopic, preferably each element of the stairway support members include individual handrails which are laterally spaced from one another so as not to interfere with one another when the step assembly is retracted.

Extending from the top of the step assembly is a platform 31. The platform also preferably includes side handrails 29 and a front gate (not shown). When the gate is open, the platform becomes open-ended so that persons upon reaching the platform may extend or walk off the open-ended section 33 of the platform. As would be understood by those skilled in the art, the platform may take numerous configurations. The platform may extend a substantial distance from the step assembly. Moreover, the platform may be significantly narrower or wider than the step assembly without departing from the spirit or scope of the invention.

The aerial lifesaver of the present invention further includes a safety assembly 34 for protecting those who are standing on the platform 31 or those who depart and continue to work in the vicinity around the platform 31. The safety assembly 34 includes a safety rail 35 which projects overhead of the platform 31. Preferably, the safety rail is sufficiently high in relation to the platform 31 that persons of six feet in height walking on the platform do not inadvertently bump their head on the safety rail. The safety rail is preferably be located between 6 feet and 8 feet, and more particularly at approximately 7½ feet, above the platform. Of course, the safety rail 35 may be slightly positioned higher or lower without departing from the spirit and scope of the invention.

The safety rail 35 is maintained in place by one or more support arms 37. As shown in the figures, it is preferred that the support arms 37 extend directly from the stairway single stage support members 17 or the multi-stage support members 17 (see FIG. 3), and turret assembly 14, so that the support members 17 and support arms 37 may be constructed as single pieces. However, the support arms 37 may be constructed as separate elements than the support members 17, such as extending directly from the base section 3, and be within the scope of the present invention.

Figure 9:
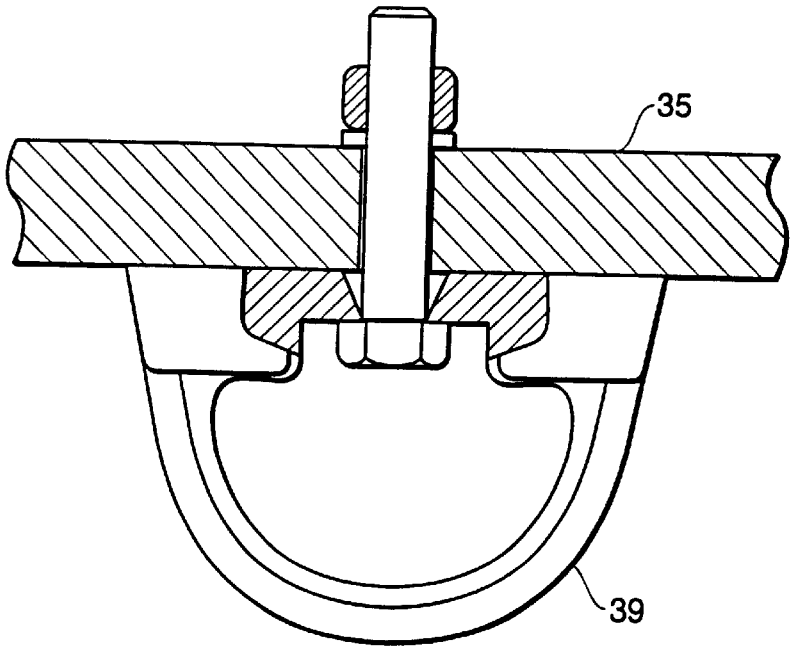
FIG. 9 is a side view of an anchor point of the safety rail of the aerial lifesaver of the present invention.

The safety rail 35 also includes one or more anchor points 39. As shown in FIG. 9, the anchor points 39 may be constructed as a fixed loop which may be affixed to the safety rail 35 by numerous fasteners known to those skilled in the art, such as a nut and bolt combination. In the alternative, though not shown in the figures, the anchor points may move longitudinally along the length of the safety rail by numerous means known to those skilled in the art.

With reference to FIGS. 4–7, the aerial lifesaver 1 of the present invention is intended for use in cooperation with persons wearing a harness 41 which is connected to a lifeline 43. The lifeline may be a simple fixed length of belt including locking means at each of the belt's extremities such as a carabiner 47 or snap lock 49. However, it is preferable that the lifeline is extendible and retractable and includes an inertial lock 51 for restricting the extension of the belt if the belt is suddenly pulled upon. Suitable lifelines may be constructed in accordance with OSHA 1910/1926 standards As shown in the figures, the aerial lifesaver of the present invention is believed to have particular application for assisting persons in working on the exterior of an airplane, such as upon the airplane's wings or fuselage. However, the aerial lifesaver of the present invention is believed to have additional applications too numerous to list herein, and the use of the aerial lifesaver of the present invention in connection with these applications is intended to be within the spirit and scope of the present invention.

Figure 6:
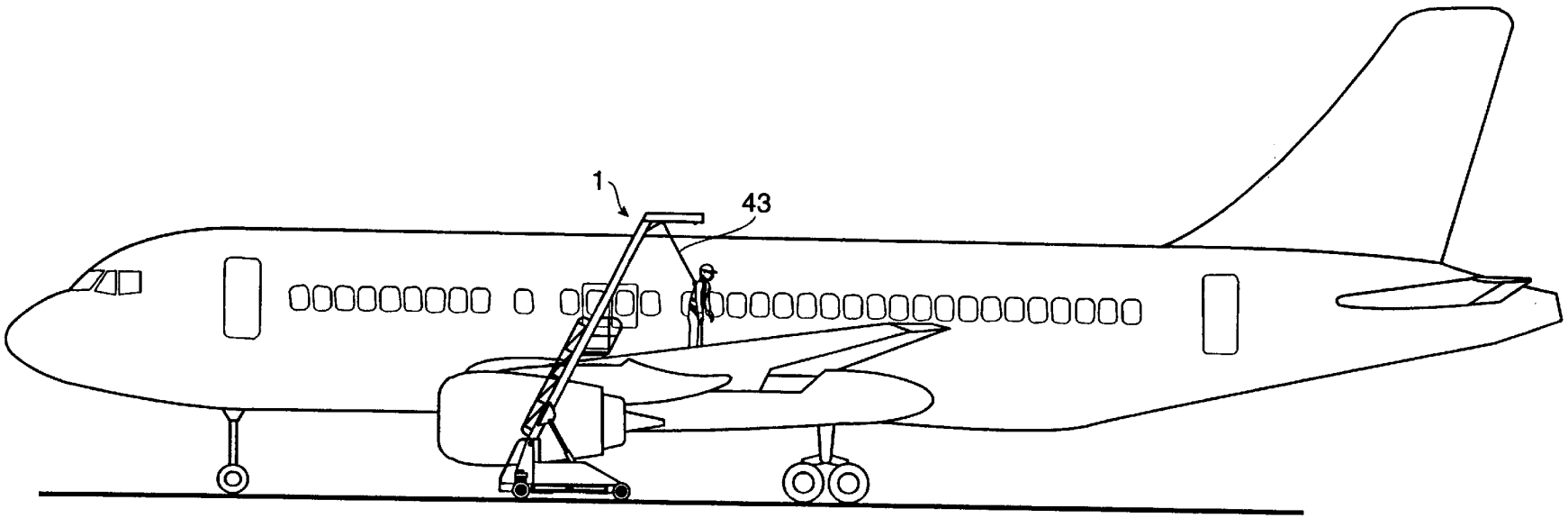
FIG. 6 is a side view of the aerial lifesaver, of the present invention in use in connection with assisting a person working on the wing of an airplane.
Figure 7:
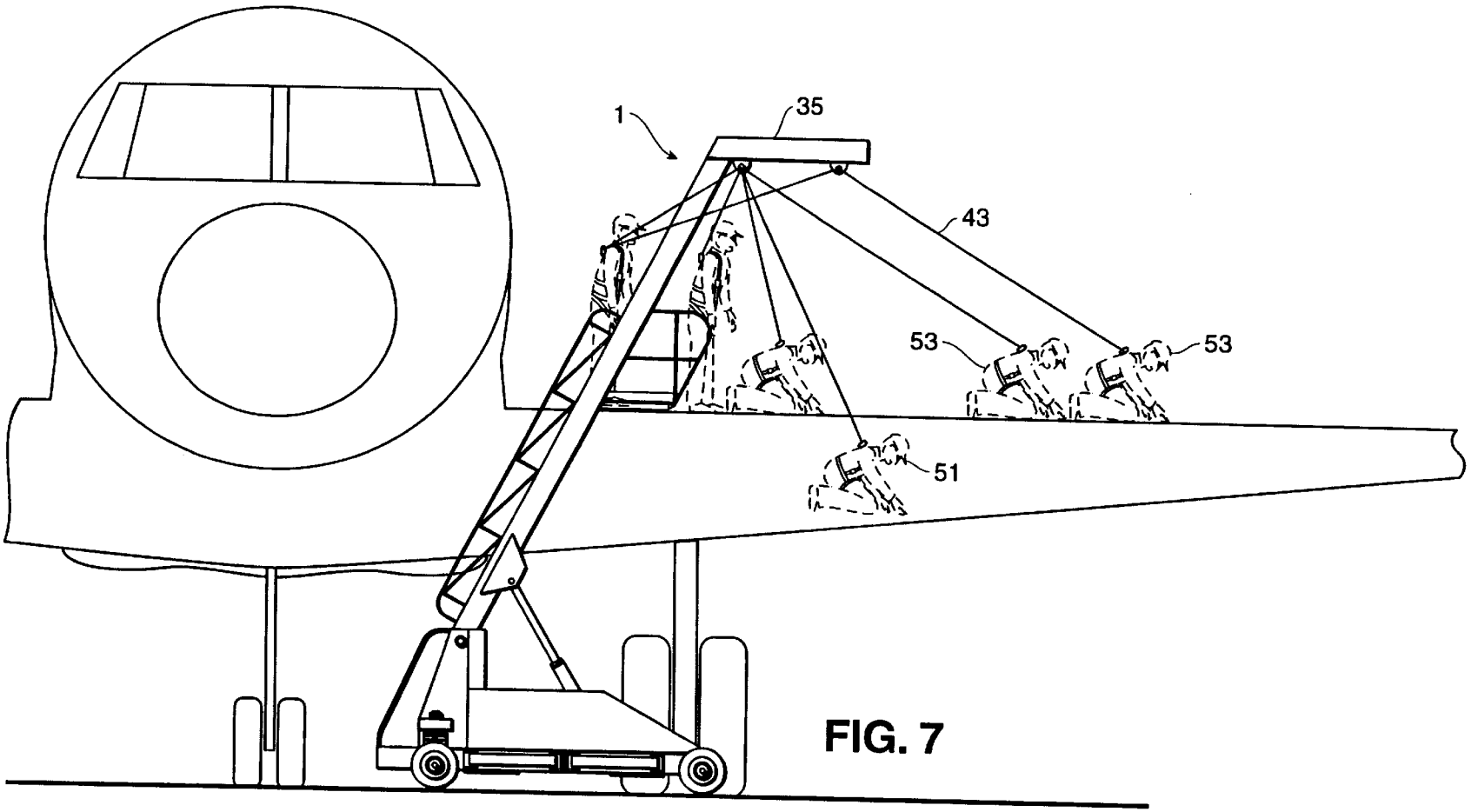
FIG. 7 is an additional side view of the aerial lifesaver of the present invention in use in connection with assisting a person working on the wing of an airplane.
Figure 8:
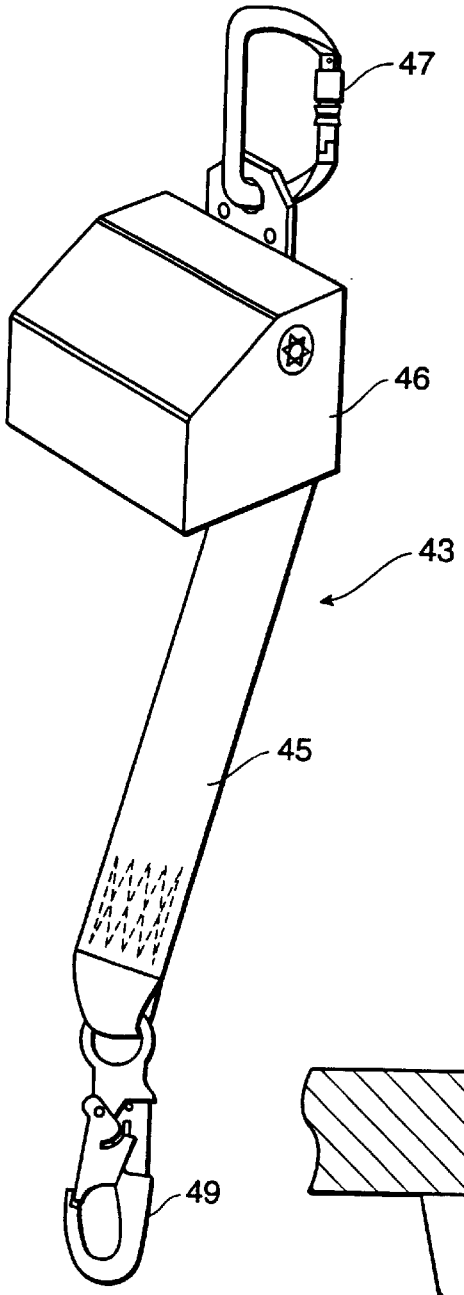
FIG. 8 is a side view of a lifeline for use in cooperation with the aerial lifesaver of the present invention.

Prior to using the aerial lifesaver1, a required number of lifelines 43 of required lengths are attached between the platform siderails 29 and anchor points 39 so that a person can use the lifelines 43 and move freely while always securely protected against falls. Thereafter, the combine is moved to a desired location and the step assembly 13 is lifted and/or extended (see FIG. 3) to a desired height. For example, as shown in FIGS. 6 and 7 the aerial lifesaver is positioned adjacent to an airplane's wings. The user, wearing the proper harness 41, then climbs the stairway protected by the stairway siderails. He then walks upon the platform 31 protected on three sides by the side rails and closed gate. Before opening the gate, the user attaches his harness to the platform end of a lifeline 43 which extends down from the safety rail 35. Upon opening the gate, the platform 31 becomes open-ended 33 and the user is free to leave the platform and walk safely to a working position 53. The user is protected from falls, and particularly protected against falling off the platform's open end 51, as the lifeline 43 connected to the user's harness 41 prevents the user from striking the ground. For example, as shown in FIG. 7, a person falling off the platform will fall only to a fall position 51 wherein the lifeline 43 and safety rail 35 will prevent the person from falling any further. Moreover, because the platform 31 is open-ended, a person utilizing the aerial lifesaver can depart from the platform and work in the vicinity of the platform in working locations 53. Thus, the aerial lifesaver of the present invention enables persons to work safely in high places without the physical constraints of a platform surrounded by handrails.

It would be understood by those skilled in the art that for different uses of the to invention, that the aerial lifesaver requires different configurations, components, lifting mechanisms, step assemblies, drive systems and control systems. The platform and step assembly may be permanently welded to a filed position when the aerial lifesaver is constructed for applications where the height of the work place is known.

Alternatively, the aerial lifesaver may be constructed to be adjustable in height, such as by including a step assembly that is adjustable in length and/or angle. Where the step assemble has an adjustable angle, it is preferred that the step by constructed as round tubes so that the step surface is the same no matter what angle the step assembly is positioned.

Although the present invention has been described with reference to the preferred embodiments, workers killed in the art will recognize that changes may be made in form and detail without departing from the spirit and scope of the invention.

Having identified the presently preferred best modes of practicing the invention, we claim:

1. A mobile safety scaffolding comprising;

a mobile base having a plurality of wheels;

a step assembly having a top and a bottom and including a plurality of steps that extend upwardly from said mobile base;

a platform located at the top of said step assembly;

a support arm having a first extremity and a second extremity, said second extremity extending above said platform;

a safety rail attached to said second extremity of said support arm and extending and positioned substantially horizontal and at least six feet above and over said platform so as to be above the head of a person standing on said platform, said safety rail also including one or more attachment points for attaching a safety harness; and a lifeline attached to one of said attachment points and an attachment means for attaching said lifeline to the person.

2. The mobile aerial lifesaver of claim 1 wherein:

said step assembly and said platform are adjustable to different heights;

and said aerial lifesaver further includes means for raising and lowering said step assembly and said platform.

3. The mobile aerial lifesaver of claim 1 wherein:

said safety rail includes a first end and a second end, said first end attached to said second extremity of said support arm and said second end extending beyond the edge of said platform.

4. The mobile safety scaffolding of claim 1 further comprising:

a harness assembly including means for dispensing and retracting said lifeline, and locking means for restricting the dispensement of said lifeline if said lifeline is suddenly tugged upon.

* * * * *